United States Patent [19]

Flum

[11] 4,416,380

[45] Nov. 22, 1983

[54] PRODUCT MERCHANDISING RACK

[75] Inventor: Paul Flum, University City, Mo.

[73] Assignee: Paul Flum Ideas, Inc., St. Louis, Mo.

[21] Appl. No.: 262,117

[22] Filed: May 11, 1981

[51] Int. Cl.[3] ..... A47F 7/28

[52] U.S. Cl. ..... 211/49 D; 211/181; 211/194; 312/72; 312/341 NR

[58] Field of Search ..... 211/49 D, 181, 186, 211/187, 188, 189, 194; 312/341 NR, 35, 42, 72

[56] References Cited

U.S. PATENT DOCUMENTS

| | | | |
|---|---|---|---|
| D. 191,082 | 8/1961 | Tigner | 211/181 |
| 325,049 | 8/1885 | Brolaski | 312/224 X |
| 2,125,000 | 7/1938 | Considine | 211/181 |
| 2,247,597 | 7/1941 | Bofenkamp et al. | 211/181 X |
| 2,600,755 | 6/1952 | Greensfelder | 211/181 |
| 2,623,641 | 12/1952 | Shield | 312/42 X |
| 2,757,051 | 7/1956 | Wilmer et al. | 312/341 |
| 2,934,212 | 4/1960 | Jacobson | 211/49 D |
| 3,279,618 | 10/1966 | Bergstedt | 211/49 D |
| 3,429,428 | 2/1969 | Fowler | 206/45.31 |
| 3,642,337 | 2/1972 | Manheim | 312/107 X |
| 3,848,937 | 11/1974 | Harder, Jr. | 312/341 X |
| 3,866,788 | 2/1975 | Smit | 211/181 X |
| 3,909,078 | 9/1975 | Riley | 312/341 X |
| 3,970,199 | 7/1976 | Marschak | 211/188 X |

FOREIGN PATENT DOCUMENTS

| | | | |
|---|---|---|---|
| 18005/34 | 5/1935 | Austria | 211/49 D |
| 1399461 | 7/1975 | United Kingdom | 297/248 |

*Primary Examiner*—J. Franklin Foss
*Assistant Examiner*—David L. Talbott
*Attorney, Agent, or Firm*—Haverstock, Garrett & Roberts

[57] ABSTRACT

A product display rack adaptable for use on a support structure for storing and merchandising shelved products comprising an open grid wire rack structure formed by a plurality of connected spaced rod members including front and rear wall portions and spaced rod members connected therebetween, the spaced rod members including a first set of spaced rod members arranged in groups to form a plurality of adjacent tracks extending between the front and rear wall portions for supporting products thereon, a second set of spaced rod members disposed above the first set of rod members to form one or more guide channels extending between the front and rear wall portions for guiding products along parallel rows therebetween, each guide channel being positioned such that a corresponding product support track is disposed therebelow, and other attached rod members for supporting the rear wall portion at a higher elevation than the front wall portion whereby rows of products positioned within the guide channels will slide along the guide channels on the respective tracks towards the front wall to maintain some of the products in each channel adjacent the front wall portion. The present device may also optionally include sleeve members attachable to the product supporting rod members to improve the slidability of products positioned thereon, or it may include special track members attachable to certain of the product supporting rod members for slidably supporting products positioned thereon.

17 Claims, 12 Drawing Figures

PRODUCT MERCHANDISING RACK

The present invention relates to a product display rack for use in storing and merchandising shelved products and, more particularly, to an open grid wire rack structure having a plurality of parallel inclined guide channels defined therein such that when products are placed respectively therein, such products will automatically slide along tracks disposed within and below each respective guide channel towards the front lower portion of the rack structure thereby continuously maintaining the products positioned therein adjacent the front wall thereof for easy access by the customer. The present rack structure can be conveniently utilized as a shelf conversion system for use on existing shelf structures commonly used in supermarkets and other food and beverage outlets as well as being adaptable for use in other display rack applications including in the modular display units shown and described in U.S. Pat. No. 3,429,428.

Recent years have witnessed a growing awareness of the value of utilizing point-of-purchase fixtures and other product display devices, and as a result of this awareness a variety of display devices including modular display fixtures have been designed and manufactured for use in merchandising shelved products to consumers. These display devices are commonly employed by supermarkets and other retail stores for use in store display windows and other display areas to show and focus attention on the merchandising wares displayed therein. One of the major problems associated with storing and displaying shelved products for sale to customers is the inefficient use of available shelf space and the inability of the merchant to continuously provide shelved products which are readily accessible to the customer at the front portion of the shelf. Proper utilization of merchandising areas is extremely important to merchants who handle a wide variety of shelved products, such as numerous bottled and canned goods, since effective use of these areas promotes sales. Typically, articles of merchandise are randomly distributed and stacked in segregated areas on a shelf or other display unit in such a manner that the selection of a particular goods item, access to that particular item, and the removability of that item from the shelf or display unit by the customer becomes, at times, difficult if not impossible. This poor utilization of shelf space also presents an unattractive and disorganized display of the products to the customer and, often results in loss of customer interest and, consequently, loss of sales. An even greater problem arises when articles of merchandise are positioned on the higher elevated shelves commonly used in supermarkets and other retail stores because once these articles are removed from adjacent the front portion of the shelf, the remaining articles stored towards the rear of the shelf are no longer as easily visible and accessible to the customer. This is counterproductive to the very purpose of displaying products to the customer in an attractive yet readily accessible manner to promote the sale thereof. None of the known devices or methods for storing and merchandising shelved products have been able to completely resolve the aforementioned problems. For these and other reasons, most known product display devices have been of limited usefulness.

The present product merchandising rack solves many of these problems and overcomes many of the disadvantages and shortcomings associated with known display devices, and teaches the construction and operation of a relatively simple open grid wire rack construction formed by a plurality of connected spaced rod members including opposed front and rear wall portions and spaced rod members connected therebetween. The rod members include a first set of spaced rod members arranged in a common plane and positioned to form a plurality of adjacent tracks extending between the front and rear wall portions forming a support bottom for supporting products thereon. A second set of spaced rod members is likewise arranged in a common plane and is disposed above the first set of spaced rod members to form parallel guide means or channels extending between the front and rear wall portions for guiding the products positioned therein in parallel rows therebetween. Other rod members are attached to the rack structure for supporting the rear wall at a higher elevation than the front wall thereby forming an inclined plane whereby products positioned on the rack will automatically slide along the first set of rod members towards the front wall so as to continuously maintain such products adjacent the front wall for easy access by the customer. The present device provides a simple and efficient means for effectively utilizing shelf space; it provides for the orderly and attractive arrangement of the products on the shelves or in other merchandising displays; and it provides a gravity feed system whereby shelved products are always maintained at the front portion of the display rack regardless of the height of the shelf relative to the customer. These features are particularly important to merchants because they enhance the accessibility to the customer of any product displayed therein and they more effectively and attractively utilize available shelf space. Because of these capabilities, the present device is particularly advantageous for use in supermarkets, convenience stores, grocery outlets, drug and liquor stores, fast food outlets, and a wide variety of other wholesale and retail stores. Two preferred embodiments of the present merchandising racks are disclosed herein, one embodiment adaptable for use with a modular display unit such as that shown and described in U.S. Pat. No. 3,429,428, and the other embodiment being especially adaptable for use as a shelf conversion system to transform existing shelves in retail stores to gravity feed merchandising shelves or systems. It is anticipated that the present devices can also be utilized in other display rack applications such as refrigerated display coolers and other merchandising systems.

Optional features of the present device may also include snap-on sleeve members or runners attachable to the product supporting rod members for improving the slidability of products positioned thereon, the use of special track members removably attachable to the product supporting rod members to accommodate and support products having varying bottom wall surfaces, and the use of a universal floor member attachable to the product supporting rod members to accommodate and support any and all products positioned thereon regardless of the shape of their bottom wall surface. The present rack devices may also include means to interconnect any number of similar racks, as desired, to form a unitized display, and may include means engageable with the support structure on which they are positioned to prevent movement thereof when installed.

It is therefore a principal object of the present invention to provide an efficient and attractive product display rack adaptable for storing and merchandising a wide variety of shelved products thereon.

Another object is to provide a product merchandising rack that is structurally and operationally relatively simple and inexpensive.

Another object is to provide a product merchandising rack having means associated therewith for continuously maintaining some of the products positioned therein adjacent the front portion thereof for easy accessibility to the customer.

Another object is to provide a product merchandising rack which more effectively utilizes available shelf space and other merchandising areas.

Another object is to provide a product merchandising rack which attractively organizes the products positioned therein in convenient parallel rows for easy access and removal.

Another object is to provide a merchandising rack which includes track means capable of accommodating a wide variety of shelved products.

Another object is to provide a product merchandising rack which can be used in concert with a plurality of other similar racks to form a unitized display to effectively accommodate almost any shelf length.

Another object is to teach the construction of a product merchandising rack which can be easily accessed by the customer for product selection and product removal.

Another object is to teach the construction of a product merchandising rack which can be easily and quickly refilled from either the front or rear.

Another object is to provide a relatively simple display rack construction which can be economically produced.

Another object is to provide a display rack construction which is lightweight, durable, easy to install and is able to withstand moderate impact and normal usage without breakage.

Another object is to provide a product merchandising rack adaptable for use with modular display units.

Another object is to provide an improved product merchandising rack adaptable for use with existing shelf systems commonly utilized in supermarkets and other merchandising centers.

Another object is to provide an inclined product merchandising rack which includes means for improving the slidability of products positioned thereon.

These and other objects and advantages of the present invention will become apparent to those skilled in the art after considering the following detailed specification which discloses several different embodiments of the subject device in conjunction with the accompanying drawings, wherein.

Figure 1:
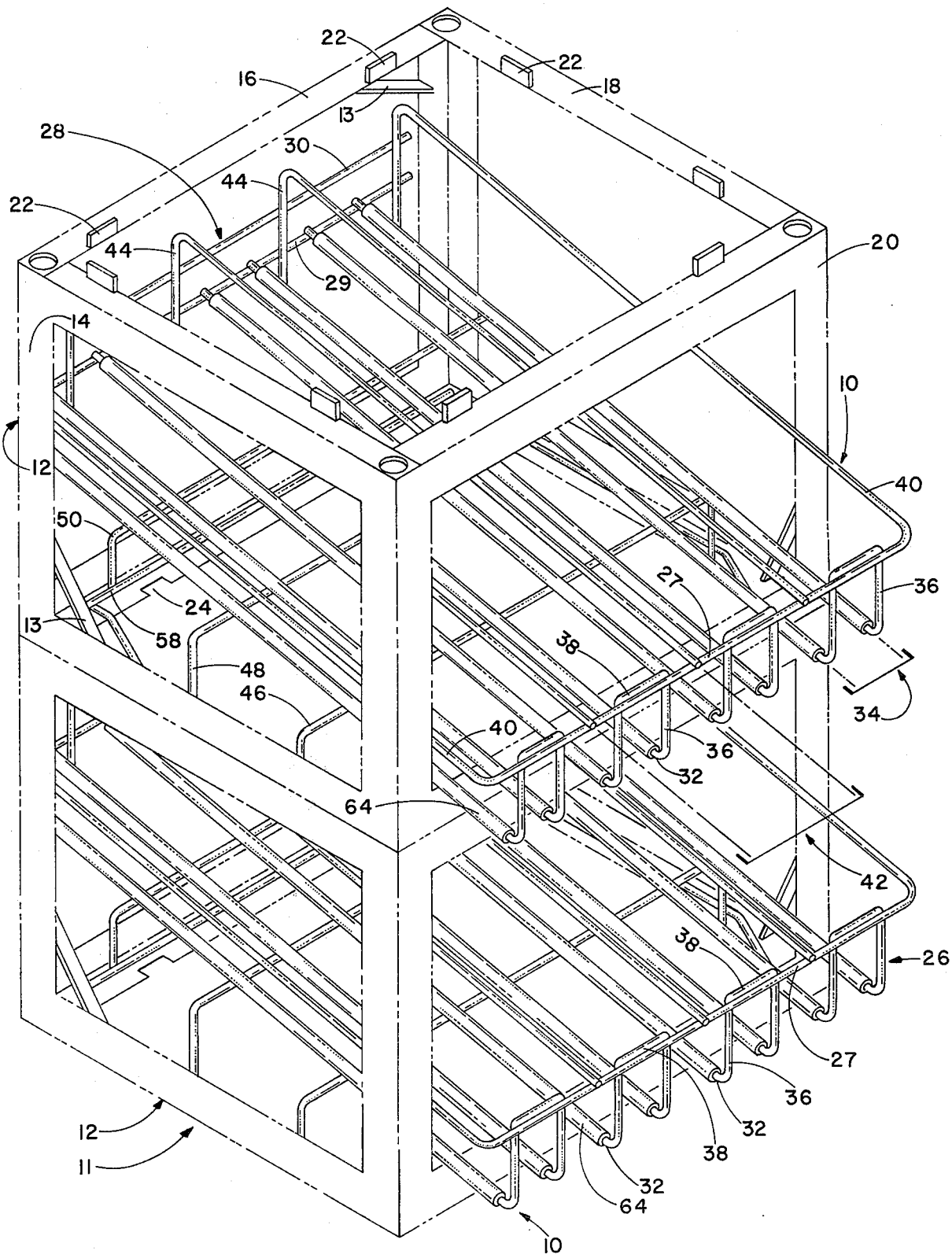
FIG. 1 is a perspective view of one embodiment of the present invention illustrating use of the subject device in a modular display unit.

Referring to the drawings more particularly by reference numbers wherein like numerals refer to like parts, number 10 in FIG. 1 identifies one embodiment of a product merchandising rack constructed according to the teachings of the present invention. The embodiment 10 is specifically designed for use in conjunction with a modular display unit 11 which includes units 12 that are conveniently adaptable for stacking in columns as shown in FIG. 1. Such devices can be assembled in stand alone columns for the merchandising of products such as soft drinks and the like. Modular display units such as the units 12 are described in U.S. Pat. No. 3,429,428, and are formed of a plurality of similar side wall panels 14, 16, 18 and 20 which interlock in such a way as to form corner posts with recessed interconnections. Vertical alignment of the stacked modules 12 is achieved by cooperative engagement between upwardly extending projections 22 on the panel upper flanges and corresponding recesses 24 formed in the lower flanges. These modular display units are commonly utilized in supermarkets and other convenience stores and are used for merchandising a wide variety of shelved products, particularly, bottled and canned soft drinks and other beverages. Although the subject merchandising racks 10 are primarily designed for use with the modular display units 12, they can be easily adaptable for use with other types of display apparatus and merchandising systems as well.

Figure 2:
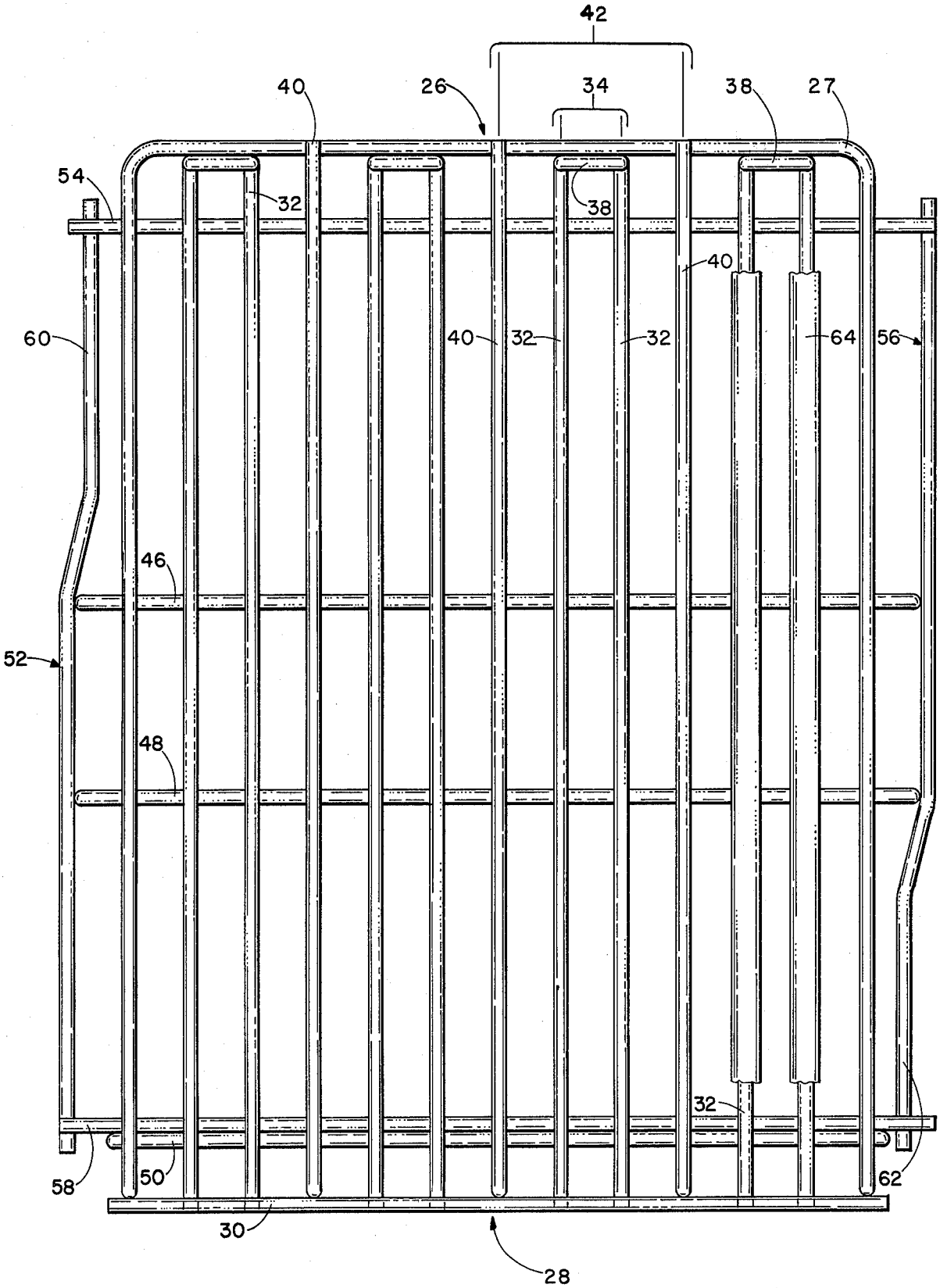
FIG. 2 is a top plan view of the rack of FIG. 1.
Figure 4:
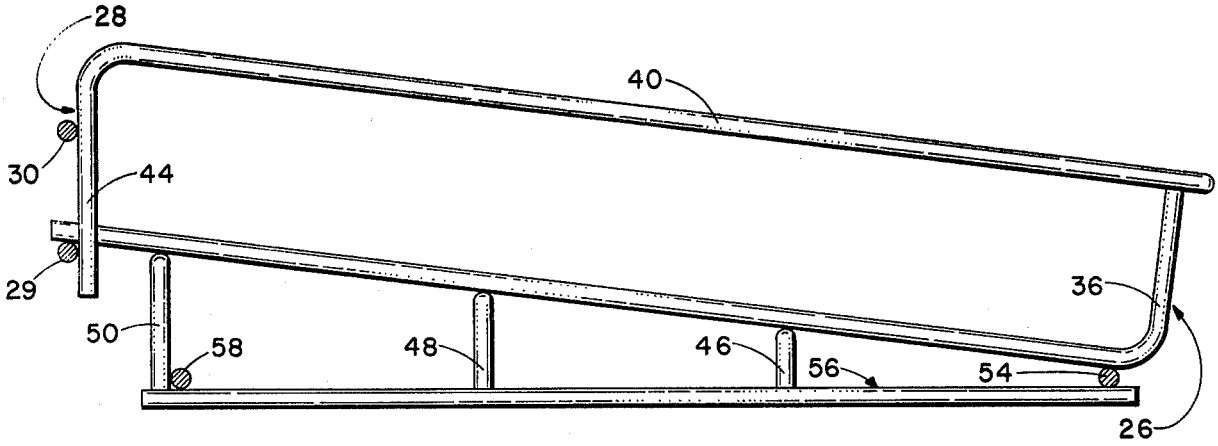
FIG. 4 is a side elevational view of the same rack.
Figure 3:
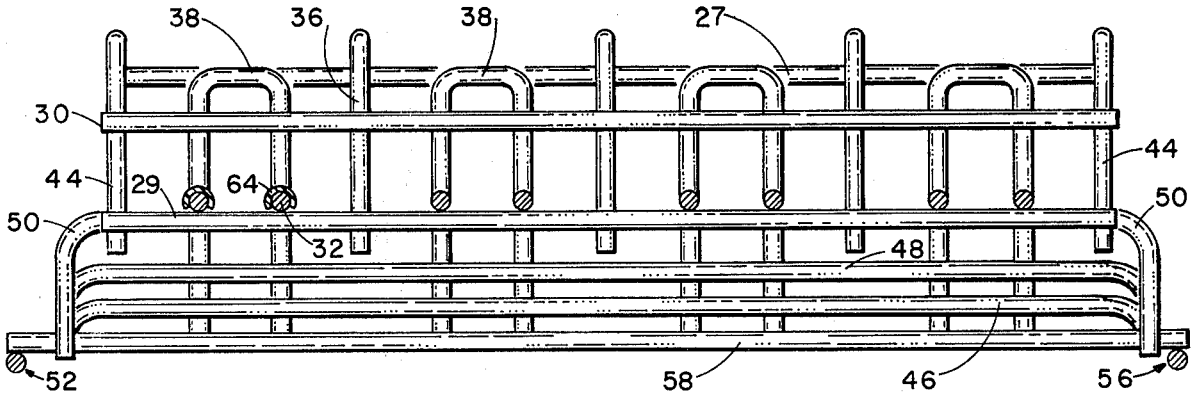
FIG. 3 is a rear elevational view of the rack of FIG. 1.

Referring to FIGS. 1–4, the merchandising rack 10 is shown as being an open grid wire rack structure formed by a plurality of spaced connected rod members including opposed front and rear wall portions 26 and 28 and spaced rod members connected therebetween. The front wall 26 is formed by a transverse rod member 27 and a plurality of upwardly extending spaced rod members 36, and the rear wall is shown formed by a pair of spaced transverse rod members 29 and 30 and a plurality of vertically extending spaced rod members 44 as shown in FIGS. 1, 3 and 4.

A first set of spaced rod members 32 arranged in a common plane and disposed in groups 34 that define a plurality of parallel adjacent tracks extend between the front and rear wall portions 26 and 28. The rods 32 form the support bottom for the merchandise positioned thereon. Each of the rod members 32 has an angularly disposed upwardly extending portion 36 which forms part of the front wall 26, and each rod portion 36 is attached at its upper end to the transverse rod member 27 which forms the top edge of the front wall (FIG. 1). It is preferred that the rod members 36 be integrally formed with the respective bottom wall rod members 32, although any conventional means for interconnecting said members such as welds, solders and other means of joinder could be utilized. The rear end portion of each rod member 32 is attached to the lower rear wall transverse rod member 29 as shown in FIG. 4.

Each group 34 of rod members 32 includes at least two spaced rod members 32 which are positioned a sufficient distance apart from each other so as to adequately hold and support most shelved products placed thereon. Although the embodiment of the present device shown in FIGS. 1–4 utilizes only two such rod members 32 to form each respective track, it is recognized that any number of such rods may be so utilized and the spacing therebetween may be varied, as desired, to accommodate the size and shape of any particular goods item placed thereon. In the particular embodiment shown in FIGS. 1–4, although not specifically required, each pair of rod members 32 and 36 which form a group 34 may include a connecting member 38 as shown in FIGS. 1–4 to lend further strength and stability to the overall rack structure 10.

A second set of spaced rod members 40 arranged in a common plane spaced above the first set of rod members 32 defines a plurality of parallel guide means or channels 42 for maintaining and guiding products positioned on the respective rod groups 34 in parallel rows. The spaced rod members 40 extend between the front and rear wall portions 26 and 28 adjacent the upper portions thereof, and each such member 44 has an angularly disposed vertically extending portion which extends downwardly along the rear of the device to form part of the rear wall portion 28 as shown in FIGS. 3 and 4. Each of the rod portions 44 is attached respectively to the rear wall transverse rod members 29 and 30 by any suitable means such as by welding, soldering and other means of joinder. Like the rod members 36 at the front of the device, it is preferred that the rod members 44 be integrally formed with the respective rod members 40, although any suitable means for interconnecting these rod portions may be utilized. It is important to note that each of the parallel extending rod members 40 is positioned to be located extending between each group 34 of the rod members 32 to form the guide means or channels 42. This particular positioning of the channels 42 relative to the lower rods 32 ensures that when rows of products are placed in the respective channels, the products will be supported on the sloping rods 32 which are sloped sufficiently and otherwise constructed as will be explained to assure that the products will slide toward the front portion of the rack. It is also preferred that the front transverse rod member 27 be formed as one continuous member with the outermost end rod members 40 as shown in FIGS. 1 and 2. The same is true of other of the connected rod members and in large measure this can be accomplished by constructing the racks using suitable jigs which will reduce to a minimum the number of separate parts required and the number of welds that are needed.

A plurality of U-shaped cross support rod members 46, 48 and 50 are attached to a substantially rectangular frame structure or base portion formed by the connected rod members or rod portions 52, 54, 56 and 58 which are positioned below and attached to the first set of spaced rod members 32. The support members 46, 48 and 50 are constructed to support the rod members 32 in an inclined or sloping position as shown in FIGS. 1–4. The incline of the members 32 means that products positioned within the respective guide channels 42 will automatically slide, under the force of gravity, along the tracks 34 towards the front wall 26 thereby continuously maintaining the products displayed in each channel adjacent the front wall. This is important because the present rack device 10 not only provides for the orderly and attractive arrangement and display of the products positioned therein, but it also provides a gravity feed system whereby the remaining products are always at the front for easy access and removal by the customer. It has been found that an inclination or slope of between about 7° to 8° provides a desirable condition such that when the up-front product is removed, the remaining products positioned therebehind will automatically slide along the respective tracks 34 in a fairly slow steady manner and without toppling over. This was found to be the case even with relatively tall plastic bottles of soft drink of the type that contain a quart or liter or more of liquid. Although an inclination or slope of between about 7° to 8° is preferred, other slopes in a range from about 3° to 10° have been tested and provide suitable results for some applications depending upon the particular display unit and the nature of the goods being merchandised therein. In addition to displaying products in an attractive yet readily accessible manner, the present device effectively utilizes the available shelf space and also allows the merchant to easily fill and refill the rack simply by sliding new products to be merchandised therein from the front or from the back. The ability to load the device from the front or rear saves time in restocking empty and partially empty racks.

Figure 5:
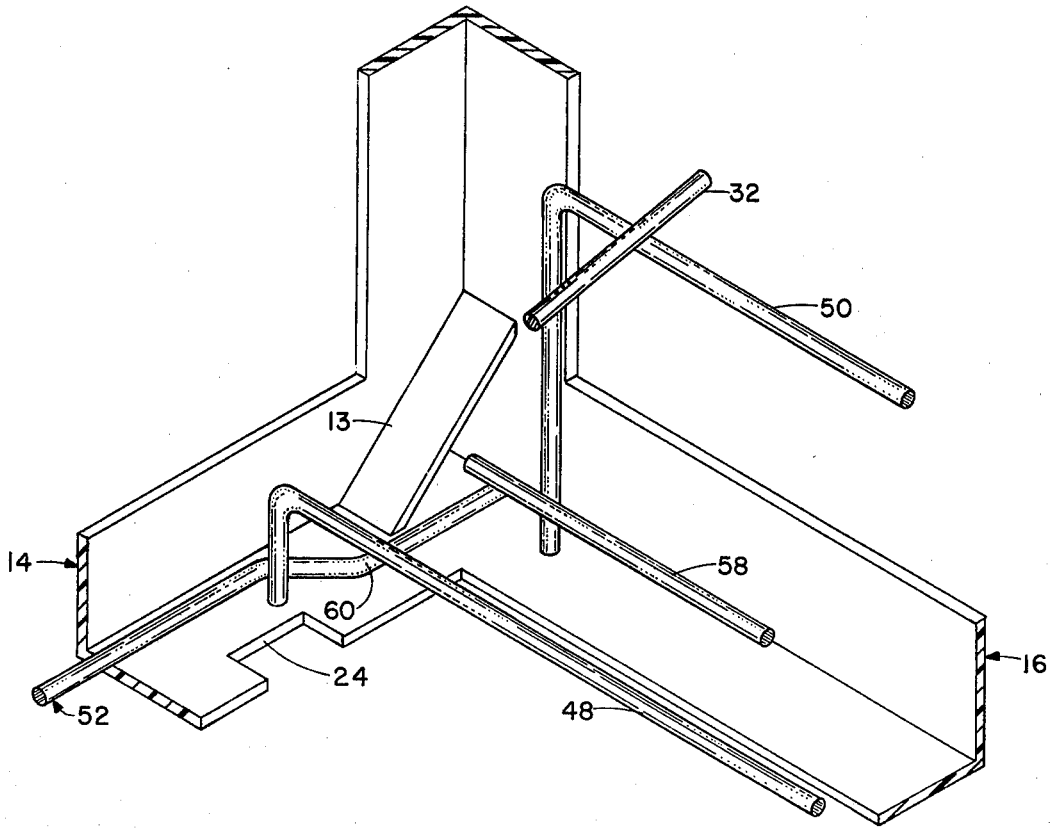
FIG. 5 is a partial perspective view of one corner of the subject rack illustrating the mating relationship between the subject rack and the modular display unit in which it is installed.

The peripheral frame structure formed by connected rod members 52, 54, 56 and 58 is designed specifically to be adaptable for use with modular display units such as the unit 12 which is shown and described in U.S. Pat. No. 3,429,428. Referring to FIGS. 1, 2 and 5, it should be noted that the side rods 52 and 56 each includes an offset end portion 60 and 62 respectively which are formed to accommodate and fit around the angularly disposed flanges or side braces 13 associated with the respective side wall panels of each display unit 12. Since all side portions of the unit 12 are the same, this means that the rack 10 can be placed in the unit 12 facing in any direction. This is an advantage because it means that the racks 10 cannot be incorrectly installed in the units 12. Although the frame structure including rods 52 and 56 is shown designed specifically to be compatible with the modular display unit 12, it can also be adapted for use with other display units and other merchandising systems as well or it can be installed for use on a shelf if desired. In addition, it is also desirable to have the front and rear wall portions 26 and 28 extend slightly beyond the respective side wall panels 20 and 16 of the modular display unit 12 as shown in FIG. 1 thereby allowing the products positioned on the rack to be even more accessible to the customer at the front portion of the rack while at the same time increasing the capacity of the device to hold products therein.

Figure 6:
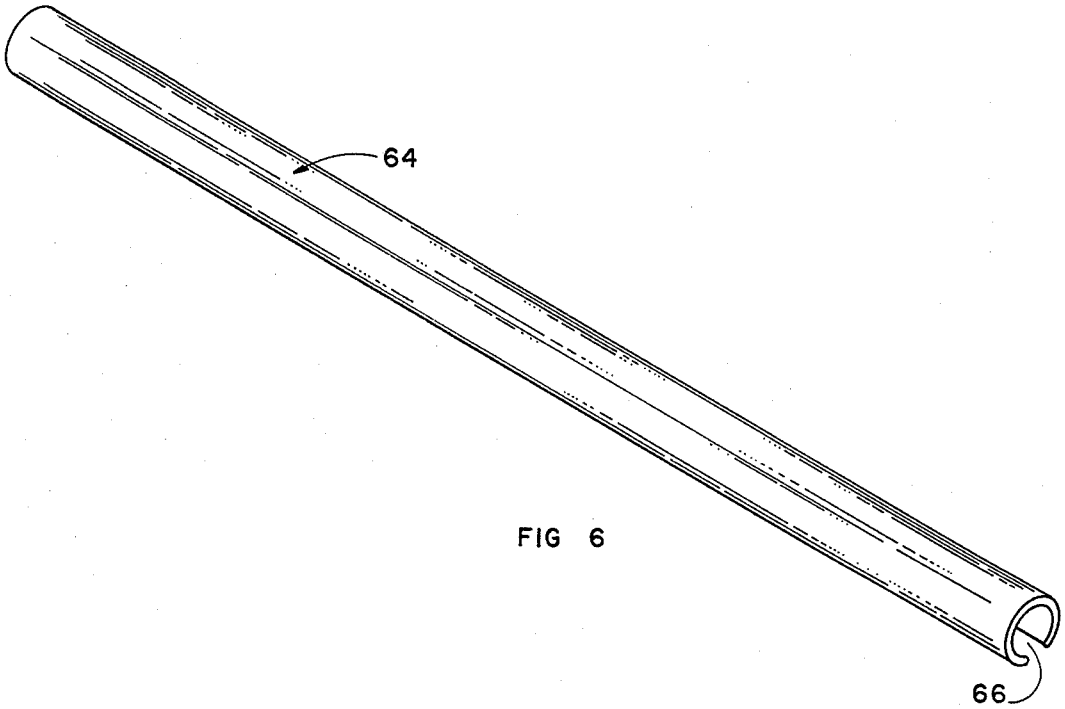
FIG. 6 is a perspective view of a snap-on tubular sleeve member for use on the subject racks.

The use of a plurality of snap-on sleeve members or runners, such as the sleeve member 64 shown in FIG. 6, on the product supporting rods 32 is desirable to improve the slidability of the products positioned thereon and also to prevent wear to the rods 32 which can make them unsightly and can cause corrosion. The sleeve members 64 are tubular in shape and are of approximately the same length as the rod members 32. The inside diameter of the member 64 is also approximately the same or even somewhat smaller than the diameter of the rods 32 so that when installed they will not easily rotate in position. A slot 66 extends the length of the member 64 and is of sufficient width to facilitate snapping and locking the members onto each rod member 32 to resist removal thereof as shown in FIGS. 2 and 3. The sleeve members or runners 64 are preferably extruded from a plastic substance such as hi-impact polystyrene, polycarbonates, various nylons, rigid vinyl compositions, or polyesters, and the plastic is preferably also mixed or impregnated with silicone as will be hereinafter explained. Various impact polystyrenes are particularly useful in the practice of this invention. Generally, the impact polystyrene will be made from relatively high percentages of polystyrene and lower percentages of rubber modifiers. The rubber modifiers may be styrene-butadiene rubber, acrylonitrile-butadiene rubber, butadiene, natural rubber and other known rubbery modifiers. A particularly useful composition is formed from a mixture consisting of a polystyrene and a styrene-butadiene rubber, the styrene-butadiene rubber being present in a range from about 10% to 25% by weight.

In the practice of this invention, the impact polystyrene is preferably mixed with a minor percentage by weight of a silicone resin. The most useful silicone resins are the liquid silicones which mix most easily with the impact polystyrene. The silicone resins are non-oxidizing, noncorrosive, non-toxic, and add lubricating properties to the impact polystyrene which is most useful in the practice of this invention. About 0.5% to 5% silicone in the member 64 is desirable although greater or lesser amounts of silicone can be used depending on the desired slidability. The combination of polystyrene and silicone produces sleeve members having relatively smooth slick surfaces exhibiting self-lubricating characteristics which, when attached to the inclined rod members 32, enables shelved products positioned thereon to move easily therealong. A particularly useful silicone resin material is Dow-Corning 200 silicone fluid additive which is comprised of a clear dimethl siloxane having a viscosity of 0.65 to 5 million c.s., marketed by Dow-Corning Corporation. It should be noted that the silicone material is generally added in a minor proportion to the impact polystyrene or other plastic substance and may be present in amounts up to about 10% by weight, although about 0.5% to 5% is generally desirable. A particularly useful combination is comprised of 2.5% by weight of Dow-Corning 200 and 97.5% by weight of styrene-butadiene modified polystyrene resin. Although not required with the present invention, the use of the sleeve members 64 substantially reduces the possibility that products stored thereon will jam or stick and not slide and their use enhances the reliability and effectiveness of the gravity feed system associated with the present devices. Also the sleeves 64 can be easily replaced as needed thereby facilitating maintenance without having to replace the whole rack or repair the same.

Many articles of merchandise are packaged in containers having unique or unusual shapes including shapes that may not adequately support them on the rod members or tracks 34 such as shown in FIG. 1. Due to the varying shapes and configurations of such products and, particularly, due to the varying configurations of the bottom wall portions thereof, the subject racks may need to be equipped with other means on which the products can be positioned. One such means may include track members such as track member 70 shown in FIG. 7 which has means for attaching it in place to the rods 32 in a rack of the type described above. The member 70 can be designed to accommodate and support various products placed thereon regardless of the shape of their bottom wall. The track member 70 is of substantially the same length as the rod members 32 and should be of sufficient width to be easily insertable into the channels 42 defined by the rod members 40, although greater widths may be utilized to meet product requirements and consumer demands. If the width of the track member 70 is greater than that of the channels 42, the member 70 may be properly positioned and attached to the rods 32 by inserting the member through one of the open grid side wall portions of the subject device 10 as shown in FIGS. 1 and 4. Each of the track members 70 includes a substantially flat base portion 72 which may have one or more upwardly extending ribs or runners such as the runners 74. The use of the runners 74 is generally preferred over a member that is flat on its upper surface because the runners 74 reduce friction between the member 70 and products positioned thereon thereby improving the slidability of that product along the member 70. The runners may be impregnated with about 0.5% to 5% silicone as hereinbefore discussed to further improve slidability and they may also help to guide the products during movement. The spacing between the runners 74 is not critical and is selected taking into account the contour of the bottom surface of the product to be positioned thereon.

Each track member 70 includes attachment means such as means 76 and associated support means 82 (FIG. 7) for attaching said members to selected ones of the rod members 32 that form the respective tracks 34. The attachment means 76 include a pair of downwardly extending semi-tubular flanges 78 and 80 defining a channel 81 therebetween for receiving and engaging one of the rod members 32. The flanges 78 and 80 are formed of resilient material and snap onto and fit around the rods 32 positioned therebetween. The channel 81 should be approximately equal to or even somewhat smaller than the diameter of the rods 32 to ensure a relatively close tight fitting engagement therewith to prevent movement of the track member 70 relative to the rod member 32 when installed. The support means 82 are substantially U-shaped channels which are wider than the diameter of the rods 32 and are formed by a base portion 84 and spaced side walls or flanges 86 and 88 extending downwardly from opposite sides of the base 84 to define a channel 90 therebetween. The channel 90 should be of sufficient width and depth to adequately or more than adequately accommodate the rods 32 yet provide support therefor. The spacing between the flanges 86 and 88 is such that the means 82 will cooperate with rods 32 of somewhat different spacings. It is anticipated however, that two or more sets of snap-on flanges such as the flanges 78 and 80 could be closely controlled. In any event the spacing between the attachment means 76 and 82 should be selected such that it corresponds to the spacing between two of the rod members 32. Although it is anticipated that any suitable attachment means may be utilized to prevent relative movement between the member 70 and the track 34 to which it is attached, the use and arrangement of attachment means 76 and 82 provides a simple, quick and efficient means for removably attaching the member 70 where desired.

Figure 10:
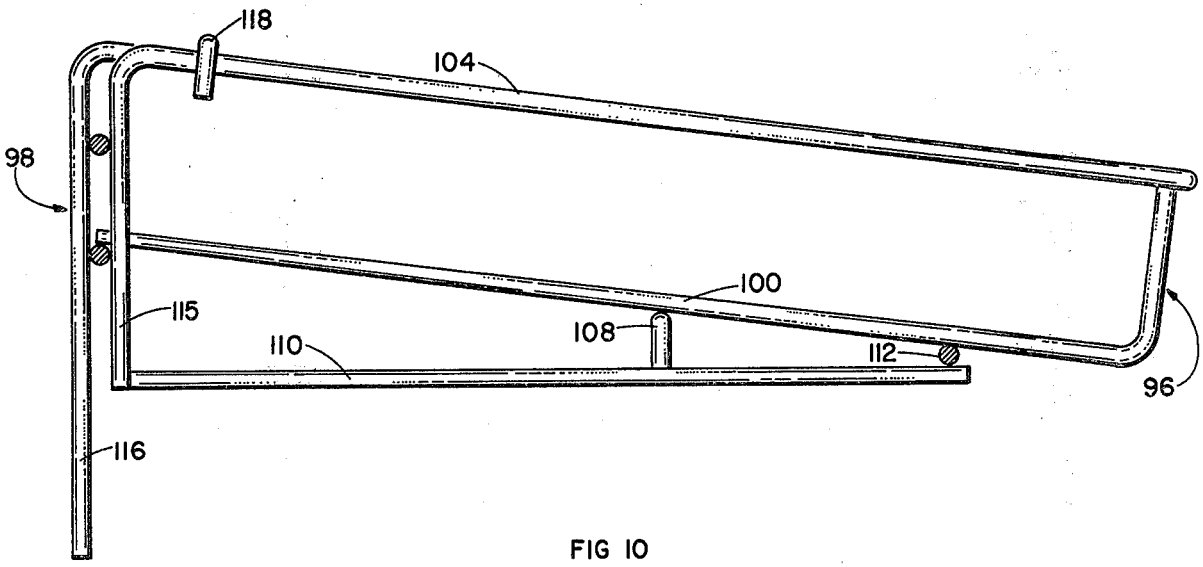
FIG. 10 is a side elevational view of the rack of FIG. 8.

FIGS. 8–11 disclose another embodiment 92 of the present product merchandising rack which is somewhat similar to the rack 10 shown in FIGS. 1–4, but is specifically adaptable for converting existing shelves, such as shelf 94 (FIG. 8), to a gravity feed merchandising system as disclosed hereinabove. The embodiment 92 includes opposed front and rear wall portions 96 and 98, a first set of spaced rod members 100 arranged in a common plane and disposed in groups such as group 102 defining a plurality of parallel adjacent members 100 which extend between the wall portions 96 and 98 adjacent the lower portions thereof, and a second set of spaced rod members 104 arranged above the first set of rod members 100 to define a plurality of parallel guide means or channels 106 extending between the front and rear wall portions 96 and 98. In like manner, one or more U-shaped cross support members such as member 108 and base support members formed by connected rod members 110, 112 and 114 are arranged to provide the structure that rests on the shelf 94. The support member 108 is attached to the rod members 110 and 114 at the ends thereof. The support members 108, 110, 112 and 114 are located to support the structure so that the rod members 100 and 104 are in inclined or sloping positions as shown in FIG. 10. This enables products positioned within the respective guide channels 106 to slide along the rods 100, under the force of gravity, towards the front wall portion 96. As with the rack 10, an inclination or slope of between about 7° to 8° has been found to provide a very desirable condition, although other slopes in a range from about 3° to 10° have been tested and provide suitable results for some applications depending on the nature of the goods being marketed.

The peripheral frame structure formed by the connected rod members 110, 112 and 114 is somewhat different from the frame structure of the rack 10 as shown in FIGS. 1–4. In particular, the side rod members 110 and 114 are substantially straight and do not include offset end portions such as the end portions 60 and 62 associated with the side rods 52 and 56. In addition, the frame structure 92 does not require a member corresponding to the rod member 54 (FIGS. 1–4), although such a member could be included for additional strength and rigidity if desired.

Figure 11:
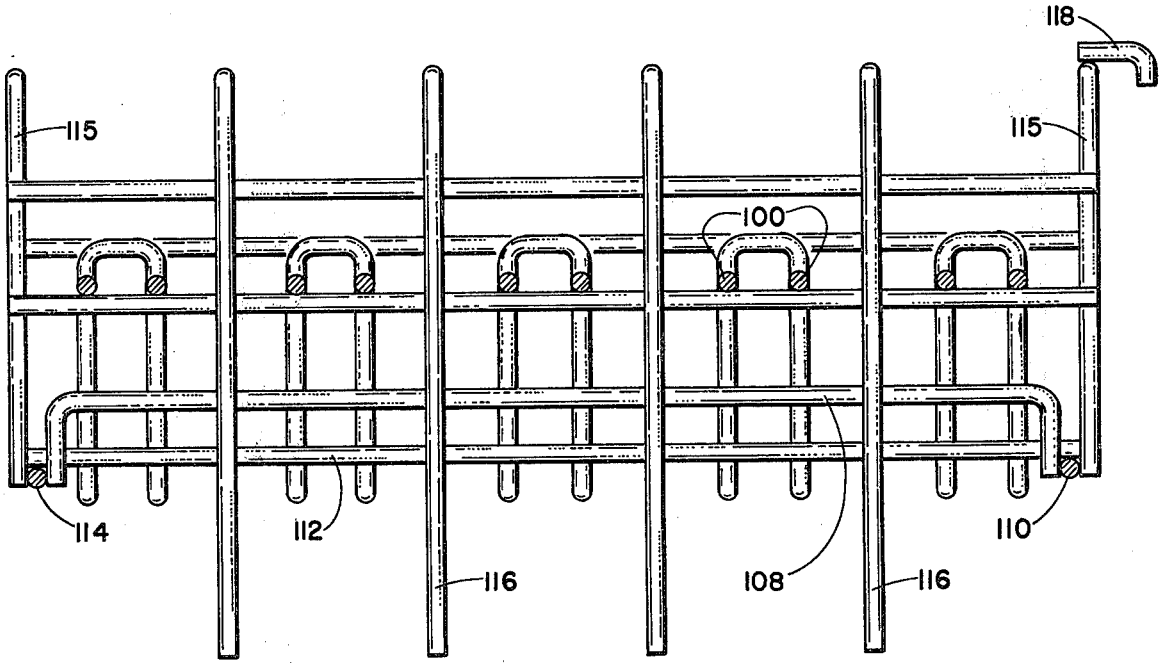
FIG. 11 is a rear elevational view of the rack of FIG. 8 showing means thereon for interlocking adjacent racks.

Each of the outermost end rod members 104 in the device as shown has an angularly disposed vertically extending portion 115 which extends downwardly along the rear of the device. The rod portions 115 are attached respectively to the frame side members 110 and 114 as shown in FIG. 11. Each of the remaining rod members 104 has an angularly disposed vertically extending portion 116 which also extends downwardly along the rear of the device. The rod portions 115 and 116 are similar to rod portions 46 and form parts of the rear wall 98 as shown in FIGS. 10 and 11. Unlike the rod members 46, however, the rod portions 116 extend downwardly somewhat below the frame structure formed by the connected rods 110, 112 and 114 (FIGS. 10 and 11). This is done so that when the rack 92 is positioned on an existing shelf such as shelf 94, the rod members 116 extend behind and below the rear portion thereof and engage the rear wall of the shelf (FIG. 8) thereby preventing forward movement of the structure on the shelf. This secures the rack 92, when installed, and prevents the device from being moved or upset by customers. Suitable clamps or fasteners (not shown) may be used to secure the frame structure to the shelf. This may include clamps or fasteners for attaching the rod portions 116 to the rear wall of the shelf and for attaching the rods 110 and 114 to the top of the shelf. Although not required, it is preferred that the rod members 115 associated with each outermost end rod member 104 not extend below the frame structure as shown in FIGS. 8 and 11 for safety reasons and for ease of handling and installation.

It is also desirable to construct the frame structure 92 such that the length of the side rods 110 and 114 are approximately equal to the depth of the shelf upon which the rack 92 will be positioned. This allows the front wall portion 96 to extend slightly beyond the front portion of the shelf 94 as shown in FIG. 8 thereby allowing the products positioned on the device to be even more accessible to the customer at the front portion of the rack. This eliminates some of the problems discussed above when articles of merchandise are positioned on conventional shelving, it increases the shelf space and the capacity of the shelf to hold products, and it provides a simple and efficient means for effectively and attractively shelving merchandise. The rack 92 also has the other desirable features of a gravity feed shelf device as explained.

Figure 12:
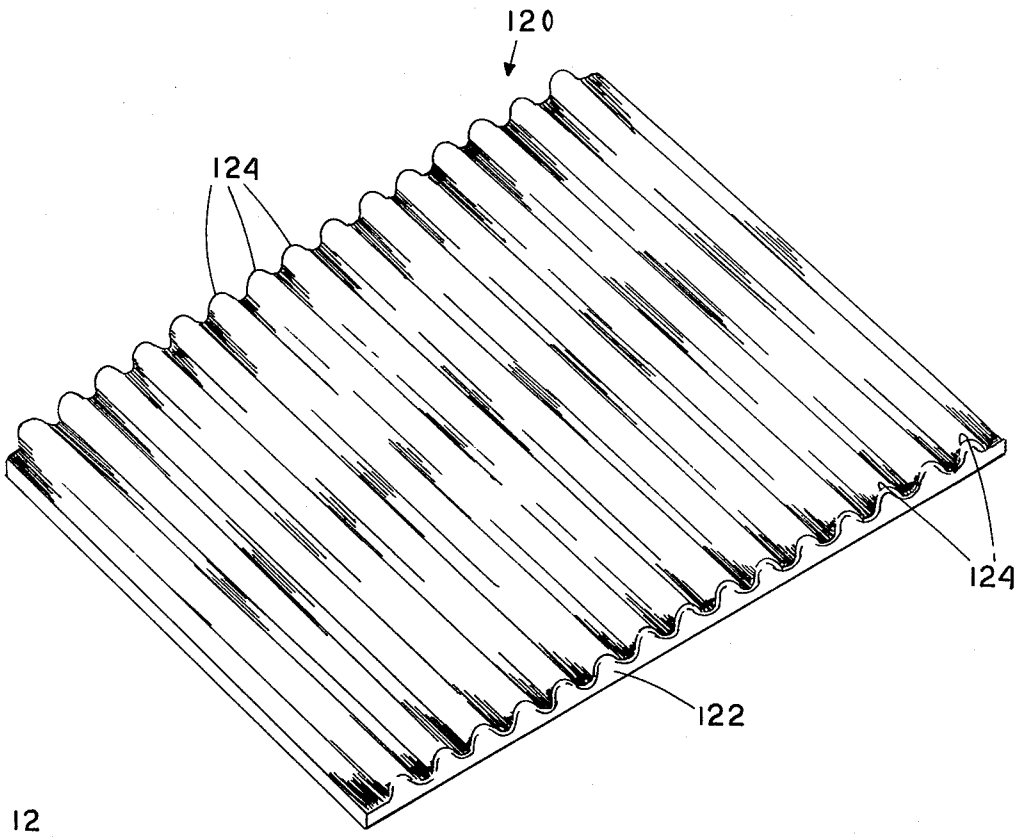
FIG. 12 is a perspective view showing still another type of track member for use on all embodiments of the subject rack.

FIG. 12 discloses another track or floor member 120 which may be employed to accommodate and support various products placed thereon regardless of the shape of their bottom wall. The member 120 includes a substantially flat base portion 122 having a plurality of ribs or runners extending upwardly therefrom such as the runners 124. Like the runners 74 associated with the track member 70, the runners 124 reduce friction between the member 120 and products positioned thereon and improve the slidability of those products along the member 120. The floor member 120 is substantially the same length as the rod members 32, however, its width may be varied as desired to accommodate any particular use and/or application. Although the member 120 of FIG. 12 is shown to be of sufficient width to extend over the entire first set of spaced rod members 32, it is recognized that the member 120, like the members 70 shown in FIGS. 7 and 8, may be made of any desired width so as to be easily insertable into the channels 42 defined by and between the rod members 40. The track or floor member 120 may be of unitary construction and formed from a relatively rigid plastic material which is also preferably mixed or impregnated with silicone to improve slidability as discussed in detail above, or the runners 124 may be extruded and vacuum formed from a single sheet of plastic material such as an impact polystyrene discussed above, which sheet of plastic is likewise preferably mixed with a silicone resin and thereafter attached by suitable means to a backing member such as to a plastic sheet, a Masonite board, a piece of particle board, or other metallic and non-metallic sheet members. Suitable clamps or fasteners (not shown) may also be provided to attach the member 120 to the rods 32.

Figure 7:
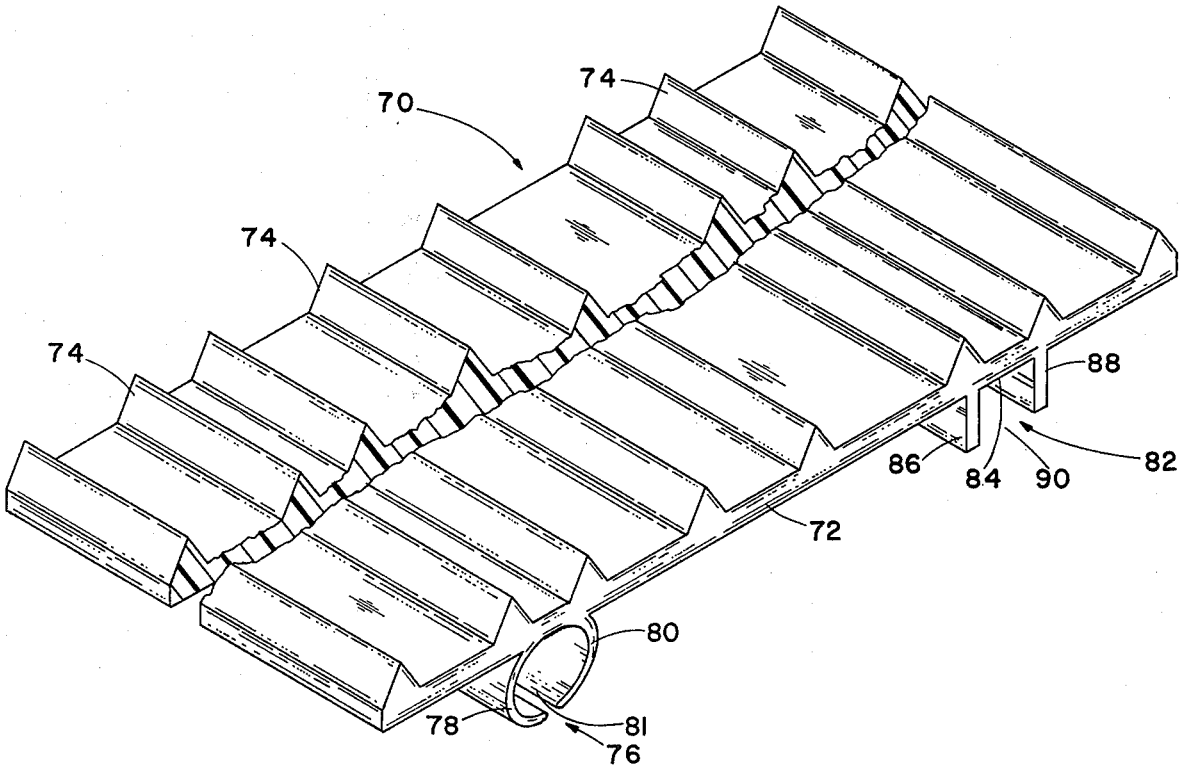
FIG. 7 is a perspective view of a removable track member for use on some embodiments of the subject rack.
Figure 8:
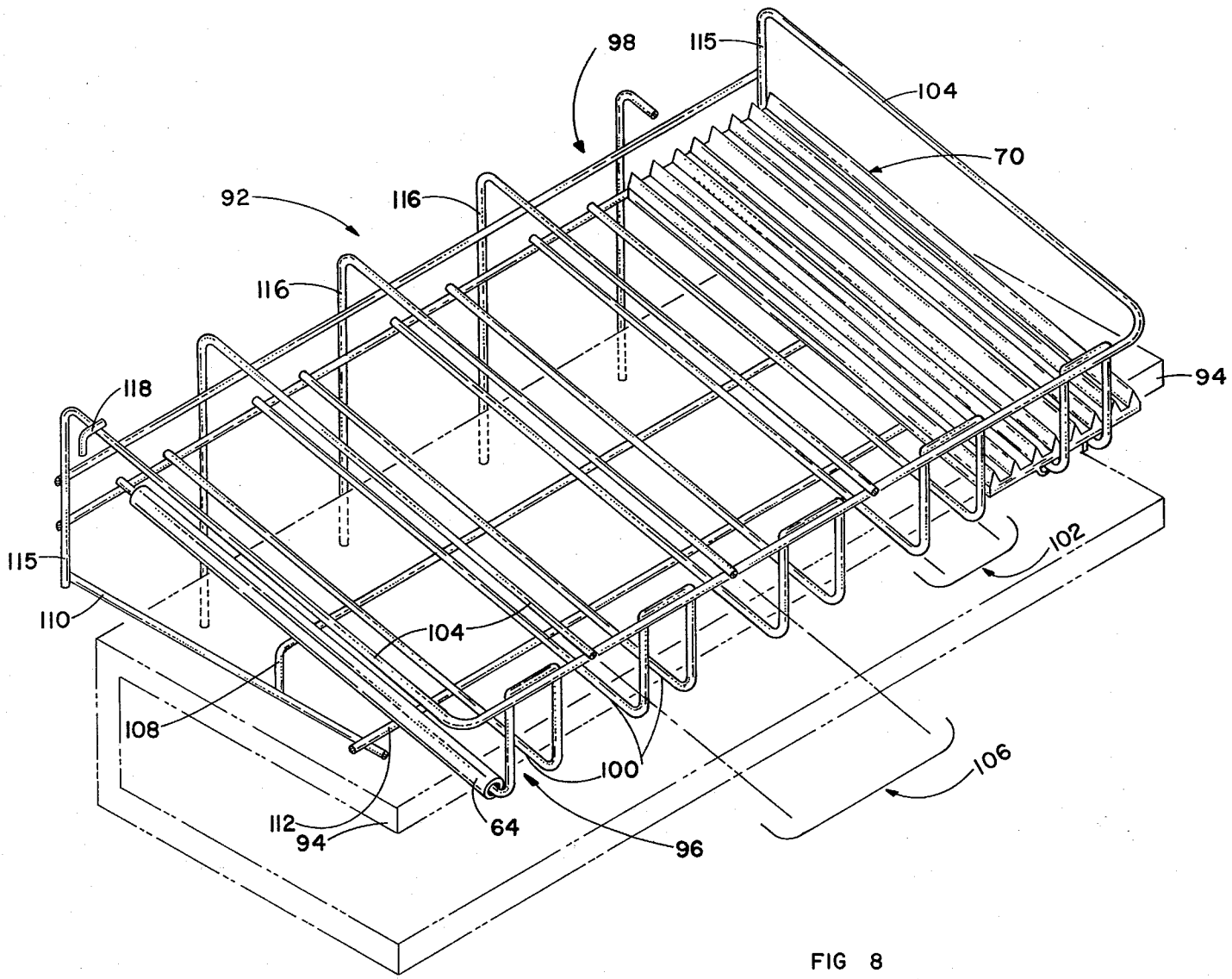
FIG. 8 is a perspective view of another embodiment of the subject rack adaptable for use in conjunction with conventional shelving.
Figure 9:
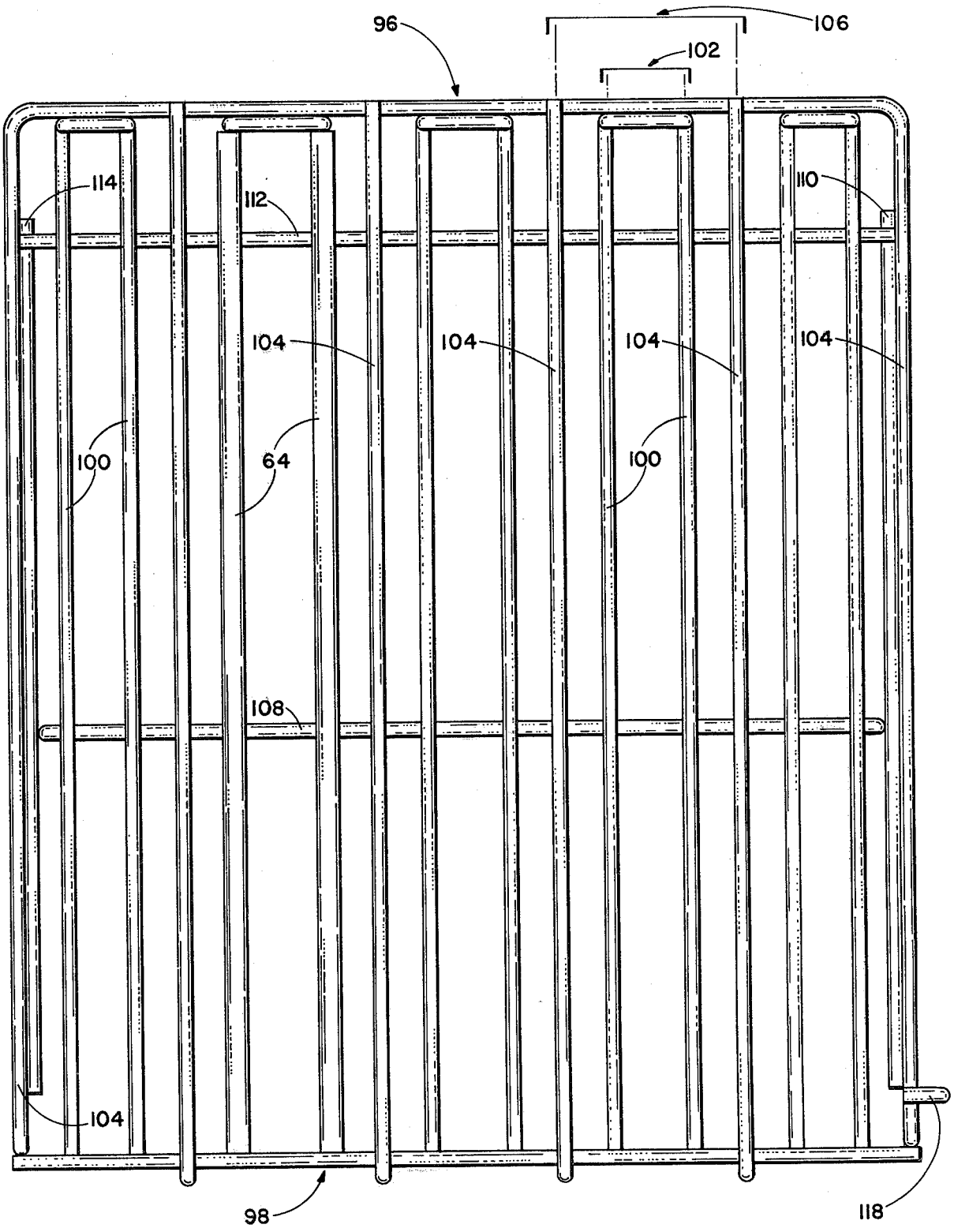
FIG. 9 is a top plan view of the rack of FIG. 8.

It is important to note that the spacing between the runners 124 is somewhat different than the spacing between the runners 74 associated with member 70 shown in FIGS. 7 and 8. In particular, the spacing between the runners 124 should be substantially uniform and relatively small so as to accommodate and support products regardless of the configuration of their bottom walls. This specific spacing selected may be important for some products that have contoured bottoms to properly support the products and reduce the chance that they will overturn. Since a floor member such as the floor member 120 is able to support and guide products of many different sizes and shapes, it is usually desirable to make the floor of sufficient width to extend over the full width of the first set of spaced rod members 32 or 100. This also reduces the number of parts that need to be provided in the construction of the device and also simplifies assembly. The use of members such as the floor member 120 therefore increases the usefulness and utility of all embodiments of the present invention.

It is anticipated that any number of similar merchandising racks such as the rack 92 may be advantageously placed in side by side relation to accommodate almost any shelf length. A hook member 118 (FIGS. 10 and 11) is attached to at least one side of each rack 92 on the members 104 for connecting and interlocking adjacent similar racks. This prevents relative movement between adjacent racks and helps to keep the racks in proper place. Additionally, members such as the sleeve members 64 (FIG. 6), the track members 70 (FIG. 7), and the floor member 120 (FIG. 12) hereinabove described may likewise be used with the rack 92.

Although it is recognized that various acceptable materials of construction are available and could equally be employed to construct the various elements of each of the embodiments, it is usually preferred that all such embodiments be constructed from standard guage wire rods such as No. 3 guage and/or No. 6 guage wire or a combination thereof, both of which are readily available and relatively inexpensive. It is also recognized that any well known metal, metal alloy, wood or even certain plastic materials may be utilized in the practice of this invention. The various embodiments of the subject racks can also be dipped in a plastic or paint substance to coat the rod portions thereof with a suitable protective coating. The selection of the material should take into account the type of product or container to be merchandised and any such coating preferably should provide the desired slideability, especially if no sleeves such as the sleeves 64 are to be used. This usually means adding a substance such as silicone or any other comparable lubricating agent to the coating material applied to the rod members. For example, the rod members 32 and 100 may be coated with a coating substance containing a quantity of a silicone resin, the silicone resin being present in the coating substance in a range from about 0.5% to 5% by weight. Such a coating can be applied by brushing, spraying or dipping. In addition, it is also recognized that various elements of each of the embodiments such as the front and rear wall portions, the side wall portions, and the rod members forming the floor or support bottom of the subject devices may be constructed of a single piece or sheet of material, not an open grid construction, so long as the other desirable features associated with the subject gravity feed shelf devices are maintained. Additionally, it can also be appreciated that the overall length and width of the various embodiments disclosed hereinbefore may be varied to accommodate different shelf or cube sizes without departing from the teachings and practice of the invention. Likewise, any number of similar rack devices may be arranged or connected adjacent to each other as required. This increases the usefulness and effectiveness of the present devices. Furthermore, signage and other indicia may be utilized on the front and/or rear wall portions for attractively advertising the particular goods items being sold and to aid the merchant when restocking the shelves.

Thus there has been shown and described several embodiments of a novel product merchandising rack for use in storing and merchandising shelved products, which racks fulfill all of the objects and advantages sought therefor. Many changes, modifications, variations, and other uses and applications of the present construction will, however, become apparent to those skilled in the art after considering this specification and the accompanying drawings, and all such changes, modifications, variations and other uses and applications which do not depart from the spirit and scope of the invention are deemed to be covered by the invention which is limited only by the claims which follow.

What is claimed is:

1. A rack device adaptable for use on a support structure for storing and merchandising shelved products comprising an open grid rack structure formed by a plurality of connected spaced rod members including a front wall portion extending substantially across the entire front portion of said device, a rear wall portion and spaced rod members connected therebetween, said spaced rod members including a first set of spaced rod members arranged in groups to form a plurality of parallel adjacent tracks extending between the front and rear wall portions for supporting rows of products thereon, each of said rod members forming said first set of spaced rod members having an angularly disposed upwardly extending portion associated therewith forming a portion of said front wall, a second set of spaced rod members disposed in a common plane above the first set of spaced rod members to form a plurality of channels extending between the front and rear wall portions for guiding products positioned on the tracks in parallel rows therebetween, each of said channels being positioned such that a respective track forms the bottom thereof, each of said rod members forming said second set of spaced rod members having an angularly disposed downwardly extending portion associated therewith forming at least a portion of said rear wall, a transverse rod member spaced above said first set of spaced rod members and extending substantially across the front portion of said device, said transverse rod member being connected to the rod members of said second set of spaced rod members and to the upwardly extending portion of each of the rod members of said first set of spaced rod members together forming said front wall, and other rod members attached to said first set of spaced rod members for supporting the rear wall portion at a higher elevation than the front wall portion when said device is supported on a horizontal surface whereby rows of products positioned in each of the channels will slide along the respective channels on the respective tracks positioned therebelow towards the front wall portion.

2. The rack device defined in claim 1 including elongated snap-on tubular sleeve members mounted on selected ones of the spaced rod members forming said first set of spaced rod members, said tubular members being dimensioned so as to extend substantially the full length of the rod members to which they are attached.

3. The rack device defined in claim 1 including a track member having means associated therewith for attaching to the tracks formed by said first set of spaced rod members to accommodate and support products positioned in the respective channels.

4. The rack device defined in claim 1 including floor means attachable to said first set of spaced rod members to accommodate and support products positioned thereon, said floor means including a substantially flat base portion having a plurality of runners extending upwardly therefrom and extending in parallel relation over the length thereof to support and guide the movement of products positioned thereon.

5. The rack device defined in claim 1 including means for interconnecting adjacent similar racks.

6. The rack device defined in claim 1 including means engageable with the support structure on which the rack structure is positioned to prevent movement thereof when installed.

7. The rack device defined in claim 1 wherein said first set of spaced rod members is inclined in operative position at an angle to the horizontal between about 3° and about 10°.

8. A rack device constructed of connected wire rod members adaptable for use on a support structure for storing and merchandising shelved products comprising an open grid rack structure formed by a plurality of connected rod members including spaced front and rear portions and spaced rod members connected therebetween, said spaced rod members including a first plurality of spaced rod members arranged in a common plane and positioned to form a product support bottom for said structure extending between and connecting said front and rear wall portions, each of said rod members forming said first plurality of spaced rod members having an angularly disposed upwardly extending portion associated therewith forming a portion of said front wall, a second plurality of spaced rod members arranged in a common plane and spaced above the plane of said first plurality of rod members, the rod members of said second plurality being parallel to each other and to the rod members of said first plurality forming parallel guide channels for maintaining and guiding products in parallel rows therebetween, each of said rod members forming said second plurality of spaced rod members having an angularly disposed downwardly extending portion associated therewith forming at least a portion of said rear wall, a transverse rod member elevated above said first plurality of spaced rod members and extending substantially entirely across the front portion of said device, said transverse rod member being attached to the rod members of said second set of spaced rod members and to the upwardly extending portion of each of the rod members of said first set of spaced rod members together forming said front wall, other rod members attached to said first pluraity of rod members for supporting the rear wall portion of said device at a higher elevation than the front wall portion whereby products to be merchandised on said device will slide along the rod members of said first plurality towards the front wall portion to maintain the remaining products in each of said parallel rows adjacent to said front wall portion, said first plurality of spaced rod members being inclined in operative position at an angle to the horizontal between about 3° and about 10°, a floor member removably attachable to the product support bottom formed by said first plurality of rod members, said floor member extending substantially the full length and width of said first plurality of rod members and including a substantially flat base portion having a plurality of parallel product supporting runners extending upwardly therefrom, said runners being formed of a material comprised of a mixture of a plastic substance and a silicone substance, said silicone substance being present in a range from about 0.5% to 5% by weight.

9. The rack device defined in claim 8 wherein said runners are formed from a mixture of materials including a hi-impact polystyrene and a silicone resin material, the silicone resin being present in a range from about 0.5% to 5% by weight.

10. A product display rack for use on a support structure for storing and merchandising shelved products comprising an open grid wire rack structure formed by a plurality of connected rod members including a front wall extending substantially across the entire front portion of said rack, a rear wall and spaced rod members connected therebetween, said rod members including a first plurality of spaced rod members positioned in groups defining a plurality of adjacent parallel tracks extending between said front and rear wall portions forming a rack bottom for supporting products thereon, each rod member of said first plurality of spaced rod members having an upwardly extending portion associated therewith forming at least a portion of said front wall, a second plurality of parallel spaced rod members disposed in the rack at an elevation above said first plurality of spaced rod members defining a plurality of parallel guide channels extending between the front and rear wall portions for maintaining and guiding products in parallel rows therebetween, each rod member of said second plurality of spaced rod members being positioned between each adjacent groups of the first plurality of rod members such that a respective track is disposed in the space below adjacent rod members of the second plurality of rod members, each of said rod members of said second plurality of spaced rod members having a downwardly extending portion associated therewith forming at least a portion of said rear wall, a transverse rod member positioned above said first set of spaced rod members and extending substantially across the front portion of said rack, said transverse rod member being attached to the rod members of said second set of spaced rod members and to the upwardly extending portion of each of the rod members of said first set of spaced rod members together forming said front wall, other rod members attached to said rack including rod members for supporting the rear wall portion at a higher elevation than the front wall portion whereby products positioned within the guide channels will slide along the respective tracks positioned therebelow towards said front wall, said first plurality of spaced rod members being inclined in operative position at an angle to the horizontal between about 3° and about 10°, tubular sleeve members engageable with selected ones of the rod members forming said first plurality of spaced rod members, said tubular sleeve members extending substantially the full length of the rod members to which they are attached and being formed of a material comprised of a plastic substance and a silicone resin, the silicone resin being present in a range from about 0.5% to about 5% by weight, means to attach the rack to the support structure to restrict movement thereof when installed, and means on at least one rack for engaging an adjacent rack to prevent relative movement therebetween.

11. The rack defined in claim 10 wherein said means to attach the rack to the support structure includes a plurality of vertically extending rod members positioned to extend downwardly along the rear of the support structure, said plurality of vertically extending rod members being formed by a continuation of the downwardly extending portion associated with some of the rod members of said second plurality of spaced rod members.

12. The rack defined in claim 10 wherein the plastic substance forming said tubular sleeve member is hi-impact polystyrene.

13. A display rack device for use in combination with a modular display unit having a plurality of similarly connected side wall panels, said rack device comprising an open grid rack structure formed by a plurality of connected rod members including opposed front and rear wall portions each having top and bottom side edges, said front wall portion extending substantially across the entire front portion of said device, a first plurality of spaced rod members arranged in groups to form a plurality of parallel adjacent tracks extending between and connecting the bottom side edges of the front and rear wall portions for supporting products positoned thereon, each of said rod members forming said first plurality of spaced rod members having an upwardly extending portion associated therewith forming a portion of said front wall, a second plurality of spaced rod members arranged and disposed at a higher elevation on the device than the first plurality of spaced rod members to form a plurality of parallel channels extending between and connecting the top side edges of the front and rear wall portions for maintaining and guiding products in parallel rows therebetween, each of said parallel channels being positioned such that a respective track is disposed therebelow, each of said rod members forming said second plurality of spaced rod members having a downwardly extending portion associated therewith forming at least a portion of said rear wall, a transverse rod member disposed above said first set of spaced rod members and extending substantially across the front portion of said device, said transverse rod member forming the top side edge of said front wall and being attached to the rod members of said second set of spaced rod members and to the upwardly extending portion of each of the rod members forming said first set of spaced rod members, other rod members attached to said first plurality of spaced rod members forming a base portion for supporting the rear wall portion at a higher elevation than the front wall portion when said device is positioned on a horizontal surface whereby rows of products placed within said parallel channels and on said tracks will slide along said tracks towards the front wall portion, said first plurality of spaced rod members being inclined in operative position at an angle to the horizontal between about 3° and about 10°, said base portion including at least one rod member having an offset portion associated therewith positioned for cooperative engagement with the modular display unit.

14. A rack device adaptable for use on a support structure for storing and merchandising shelved products comprising an open grid rack structure formed by a plurality of connected spaced rod members including front and rear wall portions and spaced rod members connected therebetween, said spaced rod members including a first set of spaced rod members arranged in groups to form a plurality of parallel adjacent tracks extending between the front and rear wall portions for supporting rows of products thereon, each of said rod members forming said first set of spaced rod members having an angularly disposed upwardly extending portion associated therewith forming at least a portion of said front wall, a second set of spaced rod members disposed in a common plane above the first set of spaced rod members to form a plurality of channels extending between the front and rear wall portions for guiding products positioned on the tracks in parallel rows therebetween, each of said channels being positioned such that a respective track forms the bottom thereof, each of said rod members forming said second set of spaced rod members having an angularly disposed downwardly extending portion associated therewith forming at least a portion of said rear wall, a transverse rod member spaced above said first set of spaced rod members and extending substantially across the front portion of said device, said transverse rod member being connected to the rod members of said second set of spaced rod members and to the upwardly extending portion of each of the rod members of said first set of spaced rod members together forming said front wall, a base portion formed by connected rod members and other rod members attached thereto and to the rod members of said first set of spaced rod members for supporting the rear wall portion at a higher elevation than the front wall portion when said device is supported on a horizontal surface whereby rows of products positioned in each of the channels will slide along the respective channels on the respective tracks positioned therebelow towards the front wall portion, said first and second sets of spaced rod members being inclined in operative position at an angle to the horizontal between about 3° and about 10°, and a plurality of vertically extending rod members extending downwardly below said base portion and along the rear of the support structure on which said device is positioned to prevent movement thereof when installed, the angularly disposed downwardly extending portion associated with some of the rod members of said second set of spaced rod members forming said plurality of vertically extending rod members.

15. The rack device defined in claim 14 including a floor member removably attachable to said first set of spaced rod members to accommodate and support products positioned thereon, said floor member extending substantially the full length and width of said first set of spaced rod members and including a substantially flat base portion having a plurality of parallel product supporting and guiding ridges formed thereon, said ridges being formed of a material comprised of a plastic substance and a silicone resin substance, said silicone resin substance being present in a range from about 0.5% to 5% by weight.

16. The rack device defined in claim 14 including cooperative engageable means for connecting together adjacent similar rack devices.

17. The rack device defined in claims 1, 13 or 14 wherein said first set of spaced rod members are coated with a coating substance containing a quantity of a silicone resin, the silicone resin being present in the coating substance in a range from about 0.5% to about 5% by weight.

* * * * *